US007197791B1

(12) United States Patent
Smith

(10) Patent No.: US 7,197,791 B1
(45) Date of Patent: Apr. 3, 2007

(54) ADJUSTABLE DOOR STOP SYSTEM

(76) Inventor: B. Jack Smith, 9945 S. 72nd East Ave., Tulsa, OK (US) 74133

( * ) Notice: Subject to any disclaimer, the term of this patent is extended or adjusted under 35 U.S.C. 154(b) by 0 days.

(21) Appl. No.: 11/162,936

(22) Filed: Sep. 28, 2005

(51) Int. Cl.
*E05D 11/06* (2006.01)

(52) U.S. Cl. ..... 16/375; 16/334

(58) Field of Classification Search ..... 16/375, 16/374, 376, 377, 332, 334, 82, 330, 322; 292/341.18, 298
See application file for complete search history.

(56) References Cited

U.S. PATENT DOCUMENTS 975,097 A * 11/1910 Wright ..... 16/330
1,455,550 A * 5/1923 Rodell ..... 16/375
1,946,837 A * 2/1934 Clayton ..... 16/330
3,333,294 A * 8/1967 Warner ..... 16/375
3,913,171 A * 10/1975 Reid ..... 16/375
4,738,002 A * 4/1988 Shank ..... 16/82
4,998,941 A 3/1991 Smith ..... 16/375
6,158,086 A * 12/2000 De Souza ..... 16/247
6,497,005 B2 * 12/2002 Apostoloff ..... 16/375
2006/0059659 A1 * 3/2006 Kim et al. ..... 16/330

FOREIGN PATENT DOCUMENTS

EP 931897 A1 * 7/1999
JP 2002339635 A * 11/2002

* cited by examiner

*Primary Examiner*—Chuck Y. Mah
(74) *Attorney, Agent, or Firm*—Head, Johnson & Kachigian

(57) ABSTRACT

An adjustable door stop system and method for a hinge mounted door having at least one hinge leaf connected to the door and at least one hinge leaf connected to the doorway. The door stop system includes a hinge pin having an axis about which the hinge leaves rotate. A first disk extends radially from one end of the hinge pin. A second disk has an opening to receive the hinge pin therethrough. A finger extends from the first disk substantially parallel to the axis of the hinge pin. A finger also extends from the second disk substantially parallel to the axis of the hinge pin. The first disk finger engages the hinge leaf connected to the doorway and the second disk finger engages the hinge leaf connected to the door to thereby stop movement of the door without contacting either the door or the doorway.

12 Claims, 3 Drawing Sheets

ADJUSTABLE DOOR STOP SYSTEM

BACKGROUND OF THE INVENTION

1. Field of the Invention

The present invention relates to an adjustable door stop system and method and may be utilized with hinge mounted doors in order to stop movement of the door at a selected position. In particular, the present invention relates to an adjustable door stop system and method that will not mar or damage the door and will not mar or damage an adjacent wall.

2. Prior Art

Door stops are well known devices which are used to prevent opening doors from causing damage to doors, to doorknobs, or to adjacent walls. Some existing door stops require special hinge leaves. The present invention is directed to a door stop system and a method that may be utilized and added to almost any standard, existing, hinged mounted door.

One known popular type of door stop is held in place by a hinge pin and includes a padded, adjustable post that rests against the doorway on one side and a padded post that rests against the door on the other side. While this functions adequately for its intended purpose, continual pressure by the post against a hollow core door will often result in damage to the door.

Applicant's prior adjustable door stop, shown and disclosed in U.S. Pat. No. 4,998,941 entitled "Adjustable Door Stop", addresses and solves this problem. Applicant's prior door stop provides an adjustable door stop that will not impact against the door at all and therefore avoid any damage to the door. Applicant's prior invention also provides an adjustable door stop that can be utilized with various hinged mounted doors.

In some cases today, the traditional wooden or metal doorway has been reduced in size and in thickness. This may be done as a modern style feature, or alternatively, to save time and expense. Accordingly, the sheet rock, paneling, or other thin material of the wall is brought up close to the doorway. Accordingly, any door stop which would traditionally rest against a rigid doorway or molding for the doorway will instead rest against the wall material, such as sheet rock, fiber board, or thin paneling. Pressure from the post or arm of the door stop over time may result in marring or damaging of the wall. Accordingly, the doorstop used to address the problem will actually create a problem of its own.

It is a principal object and purpose of the present invention to provide an adjustable door stop system and method that will neither mar or damage a door nor mar or damage a wall adjacent to the doorway.

It is a further object and purpose of the present invention to provide an adjustable door stop system and method that may be utilized with a wide variety of hinge mounted doors.

It is a further object and purpose of the present invention to provide an adjustable door stop system and a method wherein a hinge pin for the hinge leaves is prevented from axial movement.

It is a further object and purpose of the present invention to provide an adjustable door stop system that interfaces and operates with the hinges connected to the door and the doorway and will not touch or interface with the door or the doorway at all.

SUMMARY OF THE INVENTION

The present invention provides both a system and a method for an adjustable door stop for a hinge mounted door. One hinge leaf would be connected to a door while another hinge leaf would be connected to a doorway. The system includes a cylindrical hinge pin having an axis about which the hinge leaves rotate. A first disk extends radially outward from one end of the hinge pin. The radius of the first disk is larger than the radius of the pin.

A second, circular disk has an axial opening therethrough. A first disk finger extends from the first disk substantially parallel to the axis of the hinge pin and parallel to the hinge pin. A second finger extends from the second disk substantially parallel to the axis of the hinge pin and parallel to the hinge pin. The finger extending from the first disk and the finger extending form the second disk operate together to stop and arrest movement of the door at a desired position prior to either the door or the adjacent wall being marred.

A mechanism is also provided to prevent any axial movement of the hinge pin. In one embodiment, the end of the hinge pin opposite the first disk is provided with a threaded recess which receives a threaded fastener.

A mechanism is also provided to prevent movement of the first disk with respect to the second disk in a number of ways. In one embodiment, an aperture is provided through the first disk. Likewise, at least one aperture is provided into or through the second disk. A stop pin is received through the aperture in the first disk and into or through the second disk aperture.

In an alternate embodiment, the underside of the first disk may include a plurality of teeth or ridges which mate with or engage ridges or teeth on the second disk.

DETAILED DESCRIPTION OF THE PREFERRED EMBODIMENTS

The embodiment discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
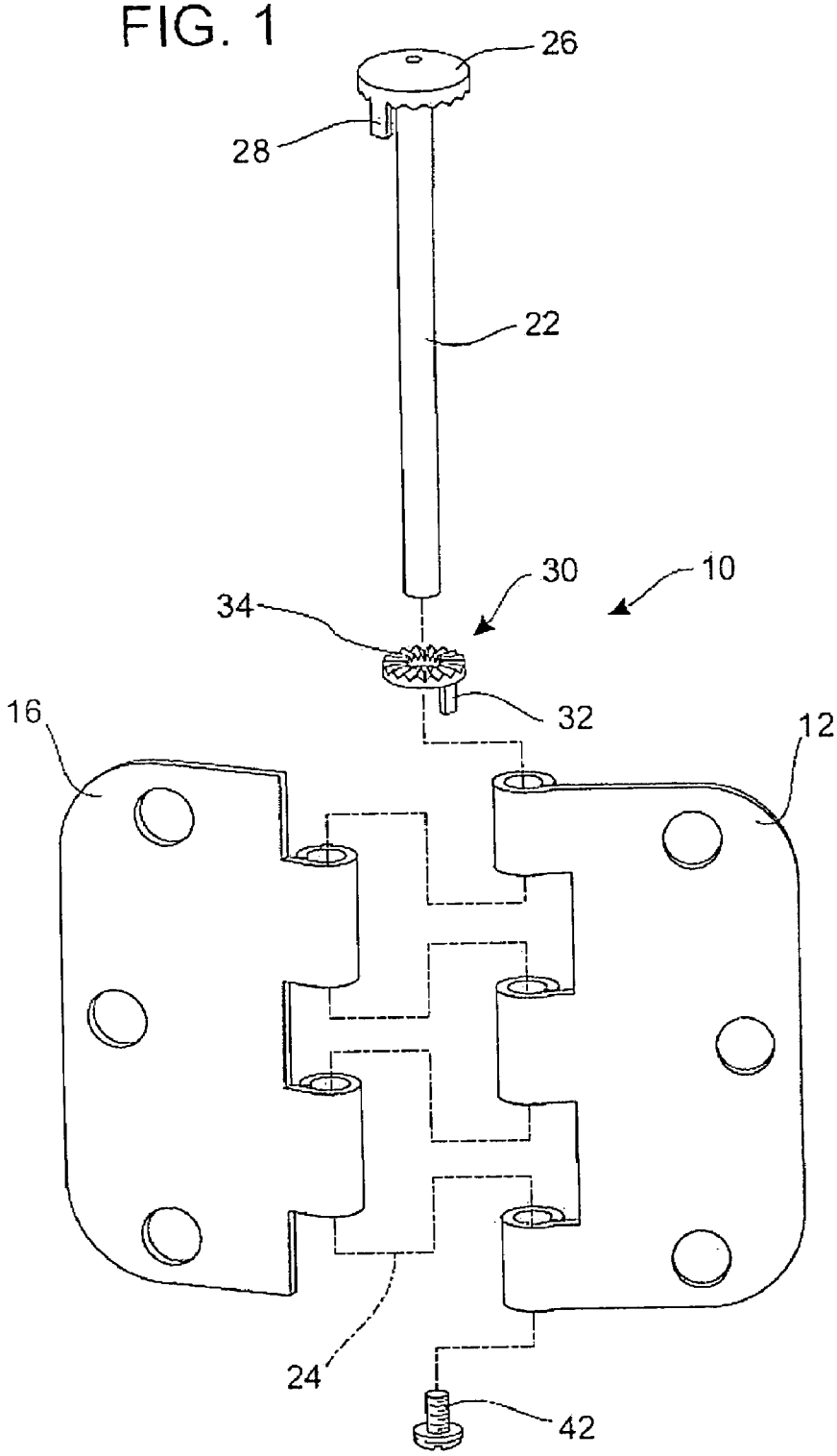
FIG. 1 illustrates an exploded view of an improved adjustable door stop system constructed in accordance with the present invention.
Figure 2:
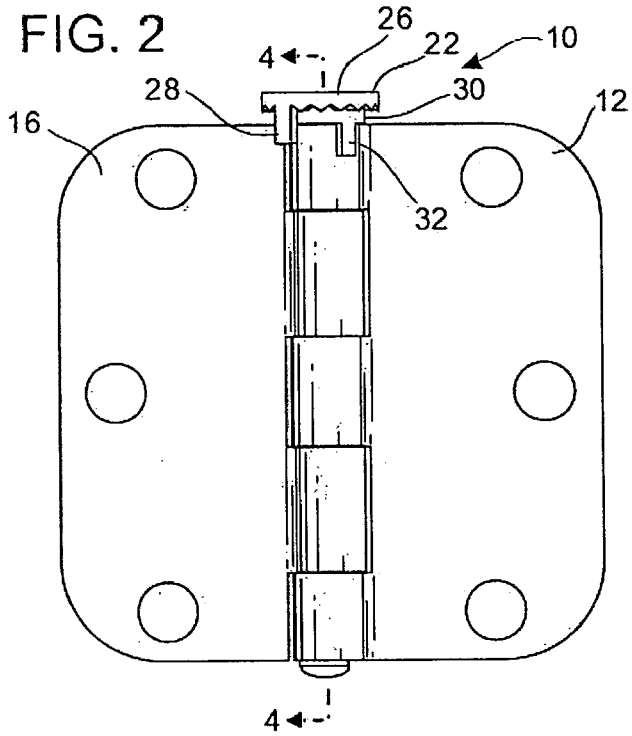
FIGS. 2 and 3 illustrate the assembled version of the improved adjustable door stop system shown in FIG. 1.
Figure 4:
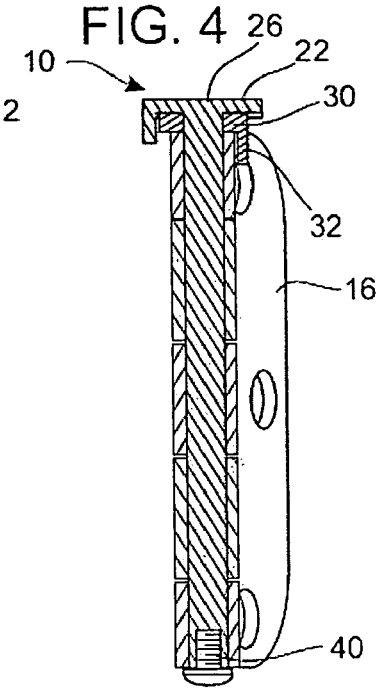
FIG. 4 illustrates a sectional view taken along section line 4-4 of FIG. 2.
Figure 3:
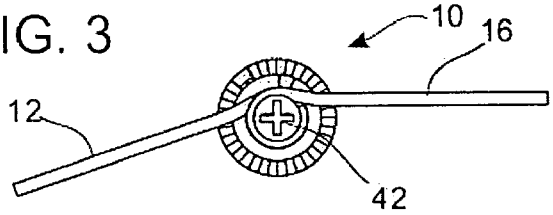

Referring to the drawings in detail, FIG. 1 shows an exploded view and FIGS. 2, 3 and 4 show assembled views of an adjustable door stop system 10 for a hinge mounted door. One hinge leaf 12 would be connected to a door 14 (not shown in FIGS. 1 through 4). Another hinge leaf 16 would be connected to a doorway 18 (not shown in FIGS. 1 through 4). The system 10 includes a cylindrical hinge pin 22 having an axis (illustrated by dashed lines 24 in FIG. 1). The hinge leaves 12 and 16 are secured by the pin 22 and rotate about the axis 24 of the hinge pin.

Figure 5:
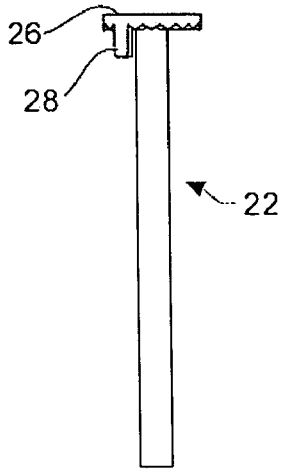
FIGS. 5 and 6 illustrate a hinge pin of the present invention apart from the device.
Figure 6:
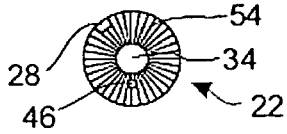

FIG. 5 illustrates a front view and FIG. 6 illustrates a bottom view of the hinge pin 22 apart from the device 10. A first disk 26 extends radially outward from one end of the hinge pin.

A first disk finger 28 extends from the first disk 26 substantially parallel to the axis 24 of the hinge pin 22 and spaced from and parallel to the hinge pin 22.

A second, circular disk 30 has an axial opening 34 therethrough. The opening receives the hinge pin. A second finger 32 extends from the second disk 30 substantially parallel to the axis 24 of the hinge pin 22 and spaced from and parallel to the hinge pin. The first disk finger extending from the first disk and the finger extending from the second disk operate together to stop and arrest movement of the door at a desired position prior to either the door or the adjacent wall being marred. Accordingly, in one arrangement, the first disk finger 28 engages the hinge leaf connected to the doorway and the second disk finger engages the hinge leaf connected to the door to stop movement of the door without contracting either the door or the doorway.

In an alternate arrangement, the first disk finger engages the hinge leaf connected to the door and the second disk finger engages the hinge leaf connected to the doorway.

A mechanism is provided to prevent any axial movement of the hinge pin. In one embodiment, the end of the hinge pin 22 opposite the first disk 26 is provided with a threaded, axial recess 40 (seen in FIG. 4) which receives a threaded fastener 42. The head of the fastener prevents the pin 22 from axial movement. While the hinge pin 22 is not normally prone to axial movement, the mechanism provides a back-up or fail safe mechanism to prevent any axial movement.

Figure 7:
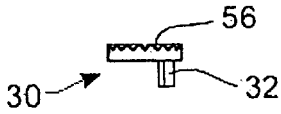
FIGS. 7 and 8 illustrate a second disk apart from the invention.
Figure 8:
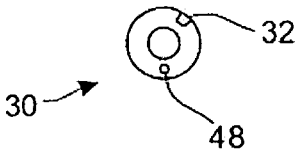

FIGS. 5 and 6 show the hinge pin apart from the device and FIGS. 7 and 8 show the second disk.

Figure 9:
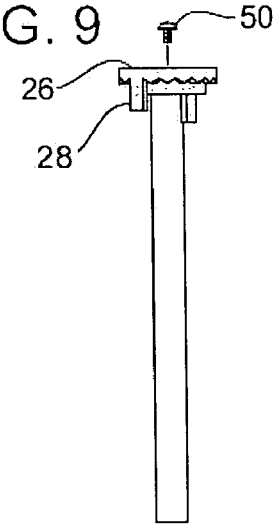
FIG. 9 illustrates the hinge pin and the second disk together.

A mechanism is also provided to prevent movement of the first disk 26 with respect to the second disk 30. This may be accomplished in a number of ways. As best seen in FIGS. 5, 6, 7, 8 and 9, an aperture 46 is provided through the first disk 26. Likewise, at least one aperture 48 is provided into or through the second disk. It will be understood that a number of apertures may be provided through each of the disks to provide a wide range of settings. A stop pin 50, seen in FIG. 9, is received through the aperture 46 and into and through the second disk aperture 48.

An alternate mechanism may also be used to prevent movement of the first disk 26 with respect to the second disk 30. The underside of the first disk 26 may include a plurality of teeth or ridges 54 which mate with and engage ridges or teeth 56 on the second disk 30.

Figure 10:
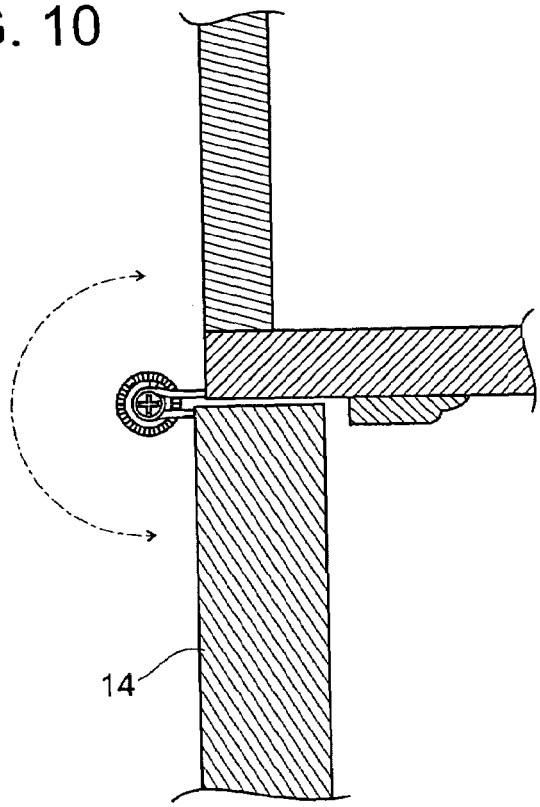
FIGS. 10 and 11 are cross-sectional views showing the invention installed with a door and a doorway.
Figure 11:
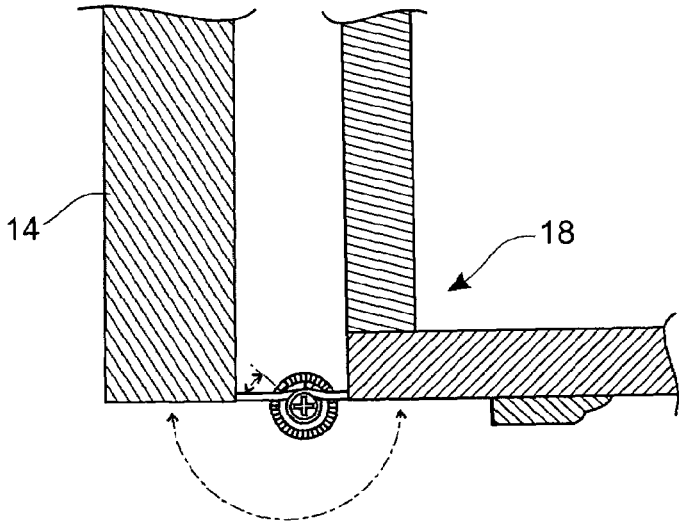

In order to utilize the adjustable door stop system of the present invention, the hinge pin 22 having the first disk 26 extending radially therefrom is inserted through the opening 34 in the second disk 30 so that the barrel of the hinge pin 22 is received through the opening of the second disk. The hinge pin 22 and the second disk are then together inserted to connect the hinge leaves 12 and 16 together. At the same time, the first disk and its accompanying first finger is oriented with respect to the second disk and its second finger so that the hinge leaves may rotate to a desired position or positions before the fingers engage the hinge leaves. Thereafter, if a stop pin 50 is utilized, it will be inserted through the first disk and into or through the second disk. Finally, the threaded fastener 42 is engaged in the threaded axial recess 40 of the hinge pin 22. FIG. 10 shows the door 14 in the closed position while FIG. 11 illustrates the door 14 moving to an opened position. When the door 14 is opened, the first disk will engage with the hinge leaf connected to either the door or the doorway and the second disk will engage with the hinge leaf connected to either the door or the doorway to thereby stop movement of the door.

Whereas, the present invention has been described in relation to the drawings attached hereto, it should be understood that other and further modifications, apart from those shown or suggested herein, may be made within the spirit and scope of this invention.

What is claimed is:

1. An adjustable door stop system for a hinge mounted door having at least one hinge leaf connected to said door and at least one hinge leaf connected to a doorway, said door stop system comprises:

a hinge pin having an axis about which said hinge leaves rotate;

a first disk extending radially from one end of said hinge pin, said first disk attached to said hinge pin;

a second disk having an opening to receive said hinge pin therethrough;

a finger extending from said first disk substantially parallel to said axis of said hinge pin;

means to prevent movement of said first disk with respect to said second disk including at least one aperture through said first disk, at least one aperture through said second disk, and a stop pin receivable through said first disk aperture and said second disk aperture; and a finger extending from said second disk substantially parallel to said axis of said hinge pin, whereby said first disk finger engages said hinge leaf connected to said doorway and whereby said second disk finger engages said hinge leaf connected to said door to thereby stop movement of said door without contacting either said door or said doorway.

2. An adjustable door stop system for a hinge mounted door as set forth in claim 1 including means to prevent axial movement of said hinge pin.

3. An adjustable door stop system for a hinge mounted door as set forth in claim 1 wherein an opposite end of said hinge pin includes an axial recess to receive a fastener therein.

4. An adjustable door stop system for hinge mounted door as set forth in claim 3 wherein said fastener is threaded and wherein said axial recess is threaded.

5. An adjustable door stop system as set forth in claim 1 wherein said stop pin is threaded and wherein at least one aperture is threaded.

6. An adjustable door stop system as set forth in claim 1 wherein said means to prevent movement includes teeth on said first disk and teeth on said second disk which mate with each other.

7. An adjustable door stop system for a hinge mounted door having at least one hinge leaf connected to said door and at least one hinge leaf connected to a doorway, said door stop system comprises:

a hinge pin having an axis about which said hinge leaves rotate;

a first disk extending radially from one end of said hinge pin, said first disk attached to said hinge pin;

a second disk having an opening to receive said hinge pin therethrough;

means to prevent movement of said first disk with respect to said second disk including at least one aperture through said first disk, at least one aperture through said second disk, and a stop pin receivable through said first disk aperture and said second disk aperture;

a finger extending from said first disk and substantially parallel to said axis of said hinge pin; and a finger extending from said second disk substantially parallel to said axis of said hinge pin, whereby said first disk finger engages said hinge leaf connected to said door and whereby said second disk finger engages said hinge leaf connected to said doorway to thereby stop movement of said door without contacting either said door or said doorway.

8. An adjustable door stop system as set forth in claim 7 including means to prevent axial movement of said hinge pin at an end of said hinge pin opposite said first disk.

9. An adjustable door stop system as set forth in claim 7 wherein an opposite end of said hinge pin includes an axial recess to receive a fastener therein.

10. An adjustable door stop system as set forth in claim 9 wherein said fastener is threaded and wherein said axial recess is threaded.

11. An adjustable door stop system as set forth in claim 7 wherein said stop pin is threaded and wherein at least one aperture is threaded.

12. An adjustable door stop system as set forth in claim 7 including means to prevent movement includes teeth on said first disk and teeth on said second disk which mate with each other.

* * * * *